US009731412B2

(12) United States Patent
Valentini

(10) Patent No.: US 9,731,412 B2
(45) Date of Patent: Aug. 15, 2017

(54) HAND OPERATED POWER TOOL

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 0 days.

(21) Appl. No.: 14/887,399

(22) Filed: Oct. 20, 2015

(65) Prior Publication Data

US 2016/0121475 A1 May 5, 2016

(30) Foreign Application Priority Data

Oct. 24, 2014 (EP) ..... 14190343

(51) Int. Cl.

| | |
|---|---|
| ***B24B 23/00*** | (2006.01) |
| ***B25F 5/02*** | (2006.01) |
| ***B24B 23/02*** | (2006.01) |
| ***B24B 23/04*** | (2006.01) |

(52) U.S. Cl.

CPC ..... *B25F 5/02* (2013.01); *B24B 23/005* (2013.01); *B24B 23/02* (2013.01); *B24B 23/04* (2013.01)

(58) Field of Classification Search

CPC ..... B25F 5/02; B24B 23/005; B24B 23/02; B24B 23/04

USPC ..... 451/344, 358, 359, 508, 509; 173/132

See application file for complete search history.

(56) References Cited

U.S. PATENT DOCUMENTS 4,610,111 A * 9/1986 Cox ..... B24B 23/02 279/6
5,564,969 A * 10/1996 Tsang ..... B24B 23/02 451/344
5,716,263 A * 2/1998 Jones ..... A46B 13/02 451/162
5,733,183 A * 3/1998 Schierling ..... B24B 45/006 15/230.19

(Continued)

FOREIGN PATENT DOCUMENTS

CN 1157587 A 8/1997
CN 1974142 A 6/2007

(Continued)

OTHER PUBLICATIONS

Communication dated May 8, 2015 enclosing the Extended European Search Report dated Apr. 27, 2015 for European Patent Application No. 14190343.5.

(Continued)

*Primary Examiner* — George Nguyen

(74) *Attorney, Agent, or Firm* — Howard & Howard Attorneys PLLC

(57) ABSTRACT

A hand operated power tool comprising a housing with a motor and a working element performing an actuating movement if the tool is actuated. The motor is adapted to actuate a tool shaft in order to make it perform a rotational movement. A carrier element is functionally located between the tool shaft actuated by the motor and the working element for translating the rotational movement of the tool shaft into the actuating movement of the working element. In order to (Continued)

provide for a power tool, which allows perfect working of a workpiece with different types of actuating movements and/or working elements, it is suggested that the working element and the carrier element make part of a functional unit constituting a unit separate of the rest of the tool, wherein the functional unit is detachably fixed to the rest of the tool, in particular to the tool shaft.

17 Claims, 5 Drawing Sheets

(56) References Cited

U.S. PATENT DOCUMENTS 5,781,955 A * 7/1998 Hendricks ..... A46B 13/02 15/22.1
5,851,142 A * 12/1998 Bullock ..... B24D 13/04 451/464
5,921,854 A 7/1999 Evensen
5,941,764 A * 8/1999 Yang ..... B23B 31/1071 279/75
6,022,267 A * 2/2000 Chyn ..... B24B 23/022 451/344
7,713,110 B2 * 5/2010 Lampka ..... B24B 23/022 15/49.1
7,789,737 B2 * 9/2010 Liersch ..... B24B 23/022 451/344
8,475,234 B2 * 7/2013 Ho ..... B24B 23/005 451/342
2005/0227598 A1 * 10/2005 Ploeger ..... B24B 23/02 451/359
2009/0318065 A1 * 12/2009 Zaiser ..... B24B 23/04 451/344
2010/0095534 A1 4/2010 Saiz
2012/0292864 A1 * 11/2012 Zhou ..... B27B 5/32 279/141

FOREIGN PATENT DOCUMENTS

DE 202007015099 U1 3/2008
DE 102009028572 A1 2/2011

OTHER PUBLICATIONS

First Office Action issued by the State Intellectual Property Office for Chinese Patent Application No. 201510696813.3 mailed Feb. 21, 2017.

* cited by examiner

HAND OPERATED POWER TOOL

CROSS-REFERENCE TO RELATED APPLICATIONS

The present application claims priority to and all the benefits of European Patent Application No. 14 190 343.5-1702, filed on Oct. 24, 2014, which is hereby expressly incorporated herein by reference in its entirety.

BACKGROUND OF THE INVENTION

1. Field of the Invention

The present invention refers to a hand held and/or hand guided power tool.

2. Description of the Related Art

Hand held and/or hand guided power tools of the type generally known in the related art usually include a housing made of a rigid material, for example a plastics material, metal, carbon fiber or the like. Part of the housing can also be provided with a resilient material, for example a resilient plastics material or rubber, in order to ensure safe and comfortable gripping, holding and guiding of the power tool by a user. Such tools often include a motor located inside the housing. The motor can be electrically driven. In that case, the motor is often a brushless direct current (BLDC) motor. The electric motor can be driven by electricity from a mains power supply or from a battery, preferably a rechargeable battery. Alternatively, the motor can be pneumatically driven, in which case the motor is a vane motor or a turbine actuated by high pressure air flow provided to the tool by an air pressure hose. The tool's motor has a motor shaft, which performs a rotational movement, when the motor and the tool, respectively, is activated.

SUMMARY OF THE INVENTION

The power tool of the present invention includes a working element located outside the housing and adapted for performing an actuating movement for working a surface of a workpiece. The working element includes at least the first two of the following layers:

- a backing plate as a support and stabilizing structure of the working element,
- a working sheet (e.g. an abrasive or polishing material), which comes into contact with the surface of the workpiece to be worked when the tool is in operation,
- a damping layer made of a resilient material and located between the backing plate and the working sheet,
- an attachment layer for detachably fixing a working sheet to the working element.

The backing plate serves as support member for the working sheet. It may be manufactured from expanded polyurethane or a similar semi-rigid plastics material. The backing plate can comprise a metal structure embedded into the polyurethane or the similar semi-rigid material for additional stability. The backing plate is particularly resistant to mechanical stresses and reduces some of the vibration during use of the power tool. The backing plate can comprise perforations, for example in the form of holes or slots. These perforations allow an air flow of dust laden air that helps to remove dust from the workpiece surface and to dissipate any heat generated by the working action.

The backing plate has a center of gravity at a certain position within the plate to assure prefect balance of the power tool during performing the actuating movement. The position of the center of gravity as well as the weight of the backing plate is designed depending on the type of actuating movement and on the type of working sheet used with the backing plate. The center of gravity can be established by local accumulation of the material of the backing plate. Alternatively appropriate counter weights, for example made of metal, could be locally incorporated into the material of the backing plate. To this end a smooth and equilibrated rotation of the working element can be assured.

The working sheet of the working element can be provided by a separate working sheet, which can be detachably connected to the attachment layer of the working element, or simply by a bottom surface of the backing plate or a damping layer. The separate working sheet can be, for example, a polishing pad comprising a polishing surface made of foam, microfiber or wool, or a sanding or abrasive sheet made of paper or a textile material. If the working sheet is designed as an integral part of the working element and the backing plate, respectively, the working element could be, for example, a grinding disc, a fleece disc, a bristle disc, a lamellar brush disc, a primary cleaning disc, a polishing disc comprising a polishing surface made of foam, microfiber or wool or the like.

If the working element is adapted for releasably attaching a separate working sheet to the working element, the working element has an attachment layer located at a bottom surface of the backing plate, if no damping layer is provided, or of the damping layer if provided. Attachment of the working sheet can be effected by a hook-and-loop connection or a mechanical adhesion. To this end, the bottom surface of the backing plate or the damping layer opposite to the tool housing and facing the surface to be worked can be provided at least partially with a Velcro® surface serving as an effective anchor for the working sheet. Similarly, a top surface of the working sheet opposite to the surface to be worked and facing the tool housing comprises at least partially a corresponding Velcro® surface.

The working element performs an actuating movement, which can be any one of the following but not limited to: a rotational, a random-orbital, a roto-orbital, a planetary a linear, and a linear alternating back and forth actuating movement or a rotary alternating actuating movement. For example, the working elements of a mixer, a drill, a power screw driver, a circular saw or a grinder usually perform a purely rotational actuating movement. The working elements of a polisher or a sander can perform a purely rotational or a random-orbital, a roto-orbital or a planetary actuating movement. Further, the working element of a power ripsaw usually performs an alternating linear back and forth actuating movement and a scraper performs an alternating rotary back and forth actuating movement. In particular with polishers and sanders the type of actuating movement depends on the type of workpiece surface to be worked, the desired result to be achieved and the type of working sheet used.

The power tool may comprise at least one first gear mechanism which can determine a certain ratio between the rotational speed of the motor shaft and the rotational speed of a tool shaft, which drives the working element. Furthermore, the power tool can comprise a second gear mechanism comprising some kind of a bevel gear in order to translate the rotational movement of the motor shaft about a first rotational axis into a rotational movement of the tool shaft about a second rotational axis, whereas the two axes intersect at a certain angle larger than 0° and smaller than 180°. Preferably, the angle of the two rotational axes is around 90°.

The first and second gear mechanism can be designed as a single gear mechanism. The tool may comprise only one of the two gear mechanisms.

In order to translate the rotational movement of the motor shaft or the tool shaft, respectively, into the actuating movement of the working element the power tool comprises a carrier element. The design of the carrier element depends on the type of actuating movement to be realized by the working element. Hence, currently there are a large number of different polishers and sanders available having different carrier elements for realizing different kinds of actuating movements. In particular, there are different polishers and sanders available for realizing purely rotational or random-orbital, roto-orbital or planetary actuating movements. Furthermore, even if the types of actuating movements are the same for different tools, for example rotary orbital or random orbital movements, they may differ from one another by the degree of the movement, for example in the case of an orbital actuating movement, by the movements' orbit. For example, currently there are random or rotary orbital sanders and polishers available, which depending on the design of the carrier element perform random- or rotary-orbital movements of 12 mm, 15 mm or 21 mm.

A random orbital polisher with an orbit of 21 mm in connection with a working element or backing plate, respectively, with a diameter of 150 mm is preferably used for working large surface areas. Such a polisher combined with a polishing pad of 150 mm or 180 mm diameter can provide for rapid cutting and an impeccable finish. Further, a random orbital polisher with an orbit of 15 mm in connection with a working element or backing plate, respectively, of a diameter of 125 mm is preferably used for working curved surfaces. Such a polisher can be combined with a polishing pad of 130 mm or 150 mm diameter and a higher rotational speed than the polisher with a 21 mm orbit. Furthermore, a random orbital polisher with an orbit of 12 mm in connection with a working element or backing plate, respectively, of a diameter of 125 mm is preferably used for deep correction operations and for anti-hologram-passes. Such a polisher can be combined with a polishing pad of 130 mm or 150 mm diameter and can reach an even higher rotational speed than the polisher with a 15 mm orbit. It is particularly suitable for edge and profile work. Other polishers known in the art with a 12 mm orbit have a working element or backing plate, respectively, with a diameter of 75 mm for achieving quick results on working areas such as mudguards, front panels etc. Yet other polishers known in the art with a 15 mm orbit have a working element or backing plate, respectively, with a diameter of 75 mm and achieve very high speeds of the actuating movement.

Furthermore, different kinds of sanders are known in the art having different characteristics of the working element for performing optimal sanding operation of a workpiece under different circumstances.

It is clear that in order to achieve a perfect detailing work of a workpiece, for example a vehicle body or a boat hull, comprising sanding with different kinds of sanding machines and polishing with different kinds of polishing machines, many different conventional polishing and/or sanding machines are necessary. This is rather expensive for the operator and requires a large storage space on the operator's side for storing those machines currently not in use.

Therefore, it is an object of the present invention to provide a hand held and/or hand guided power tool, which allows perfect working of the surface of a workpiece with different types of actuating movements and/or working elements. In particular it is suggested that the working element and the carrier element make part of a functional unit constituting a unit separate from the rest of the tool, wherein the functional unit is detachably fixed to the rest of the tool.

According to the present invention a plurality of different functional units, performing different actuating movements and/or comprising different types of working elements, are detachably fixed to the tool shaft of the tool. Hence, each of the plurality of functional units, which can be attached to the rest of the tool, is characterized by at least a certain type of actuating movement of the working element and the type of working element used. According to the invention, not only the working element of a tool can be replaced but at the same time the carrier element, too. The working element and the carrier unit form a unique functional unit detachably connected to the rest of the tool.

According to the present invention it is suggested that the entire tool carrier and not only the working element or the backing plate, respectively, can be detached from the tool as a single functional unit and replaced by a different functional unit having different characteristics. In this manner, a multi-action power tool can be realized which can perform different types of actuating movements, for example a rotational, a random-orbital, a roto-orbital, a planetary, an alternating linear or rotary back and forth actuating movement. Different types of actuating movements could be used, for example, for sanding and for polishing a workpiece surface. Furthermore, the multi-action power tool could also be used for realizing the same type of actuating movement of the working element but at different degrees, for example the orbit of an orbital actuating movement or the path of an alternating movement could be different. Finally, the multi-action power tool could use different types and dimensions of working elements, for example, delta shaped, triangular, rectangular, circular working elements. The different working elements could comprise different characteristics (material, flexibility, type of connection, etc.) of the backing plates, the damping layers, or the attachment layer. For realizing such a multi-action power tool the operator has to buy and store only different types of functional units each comprising a carrier element and a working element. The functional units are much cheaper and easier to store than the same number of different types of conventional power tools. This makes this type of multi-action power tool according to the present invention particularly interesting for smaller body and detailing shops or for dedicated private users.

According to one embodiment of the present invention it is suggested that the functional unit is fixed to the rest of the tool by a releasable connection, which is torque proof at least in one direction of rotation of the working element. This means that a torque applied by the tool shaft upon activation of the tool can be transmitted to the carrier element of the functional unit via the releasable connection at least in one direction of rotation of the tool shaft. Of course, there are various possibilities for releasably fixing the functional unit to the rest of the tool in a torque proof manner. According to a preferred embodiment of the invention it is suggested that the carrier element of the functional unit is detachably fixed to the tool shaft by a threaded connection designed such that acceleration of the tool shaft upon activation of the tool will fasten the threaded connection and tighten the fixation of the functional unit to the rest of the tool. Preferably, seen from the same side (e.g. form the top of the tool or from below the tool), the direction of the thread of the threaded connection is opposite to the direction of the rotational movement of the tool shaft. Hence, by activating the power tool, which leads to an acceleration and a rotation of the tool shaft, the threaded connection is fastened, thereby preventing an unintentional loosening of the functional unit from the rest of the tool.

To this end, the tool shaft may comprise an external thread and the functional unit, in particular a shaft of the carrier element, may comprise a bore with a corresponding internal thread. Of course, it is also possible that the external thread is embodied on the shaft of the carrier element and the tool shaft and the corresponding internal thread is provided in a bore of the tool shaft. Furthermore, the tool shaft and the shaft of the carrier element could also be introduced into one another in an insertion direction running essentially parallel in respect to rotational axis of the tool shaft, i.e. essentially perpendicular to the direction of rotation of the tool shaft. To this end guiding rails and corresponding grooves could be provided on the tool shaft and the shaft of the carrier element, respectively, in order to transmit the torque from the tool shaft to the carrier element in both directions of rotation. The functional unit could be secured to the tool shaft by a nut or any other fixing device adapted for realizing the threaded connection. Such a threaded connection allows an easy and quick exchange of the functional unit by the operator of the tool.

According to another embodiment of the present invention it is suggested that the rest of the tool comprises a receiving section to which the functional unit is detachably fixed, wherein said receiving section makes part of the tool shaft. Of course, the functional units are adapted to be releasably connected to a certain type of power tool having a certain type of receiving section. Hence, the manufacturer of the power tool could offer a variety of different types of power tool bodies comprising at least the housing, the motor, a gear mechanism, a motor controller and actuating devices for the operator to actuate the tool. Different power tool bodies could be provided for private end users, for dedicated end users and smaller companies, and for large professional companies. The different power tool bodies could differentiate from one another by the maximum rotational speed, the maximum power of the motor, the color and finishing of the tool housing and/or the number and type of actuating devices. Further, the tool manufacturer or third party suppliers can provide a plurality of different types of functional units comprising different carrier units and/or working elements adapted to be connected to the different types of power tool bodies. This allows an easy, quick and cheap realization of multi-action power tools adapted to the different needs of different kinds of operators.

Preferably, the receiving section makes part of the tool shaft, which is brought into a rotational movement about its rotational axis by the motor and to which said carrier element of the functional unit is detachably fixed in a torque-proof manner. The tool shaft can be identical to the motor shaft or it could be a separate part, for example separated from the motor shaft or from another tool shaft by a gear mechanism. The rotational axis of the tool shaft actuated by the motor could be located in a certain angle, for example 98°, in respect to a rotational axis of another tool shaft to which the functional unit is attached.

It is further suggested that the working element of the functional unit comprises a backing plate and a working sheet in contact with the surface to be worked upon operation of the tool. There may be a damping layer between the backing plate and the working sheet. The working sheet can be an integral part of the working element, for example located on a bottom surface of the backing plate or the damping layer, if present. In that case no separate working sheet is necessary. Furthermore, the bottom surface of the backing plate or the damping layer, if present, can be provided with an attachment layer of releasably attaching a separate working sheet.

The presence of the separate functional unit, which is releasably attached to the rest of the tool, does not exclude the possibility to exchange or replace the working element. The exchange of the working element can be necessary in order to replace a worn out backing plate and/or damping layer by a working element having a new backing plate and/or damping layer. The working element is preferably connected to the carrier element by a threaded connection. The working element is removed from the functional unit, for example, by blocking a rotation of the working element in respect to the carrier element and by loosening the threaded connection. After removal of the former working element a new working element can be attached to the carrier element by the threaded connection. After having fixed the working element to the functional unit, the rotational blocking is released, thereby allowing a free rotational movement of the working element in respect to the carrier element. This embodiment allows use of a single functional unit with different types of backing plates, for example being made of different material, having different weights and/or centers of gravity, being provided with or without damping layers, being provided with damping layers made of different materials, being provided with or without separate working sheets, being adapted for mounting different working sheets or having different forms and dimensions. In particular, different circular backing plates could have different diameters of 30 mm, 50 mm, 75 mm, 125 mm, 150 mm, or 180 mm. Further, a separate working sheet for polishing to be attached to the bottom of the backing plate or the damping layer, if present, could comprise a polishing pad made of foam, wool or microfiber. Of course, any other dimension or material of the backing plate would be possible, too.

According to one embodiment, a plurality of different functional units are available, each of which can be detachably fixed to the rest of the tool and each of which has a carrier element designed such that the working element of the functional unit performs a certain type of actuating movement, the actuating movements of the working elements of the different functional units differing from one another by type and/or degree. The user of the tool can have a plurality of different functional units at hand all adapted for use with a certain type of tool body. The functional units differ from one another at least by the actuating movement they perform. The actuating movement is defined primarily by the design of the carrier element of the functional unit.

Preferably, the differing types of actuating movements performed by the working elements of the different functional units comprise one or more of the following kind: a rotational, a random-orbital, a roto-orbital, a planetary, a linear, an alternating linear or rotary back-and-forth actuating movement. Furthermore, the differing types of actuating movements performed by the working elements of the different functional units comprise actuating movements of the same kind but with different degrees. This means, for example, that the orbits of orbital actuating movements differ between the different functional units. The orbit of an orbital actuating movement can be, for example, for backing plates with smaller diameters of 30 or 50 mm: 1.5 mm, 2.5 mm, 3 mm, 5 mm, and for larger backing plates: 12 mm, 15 mm, or 21 mm. Of course, any other orbit dimension is possible, too.

It is further suggested that a plurality of different functional units are available, each of which can be detachably fixed to the rest of the tool and each of which has a working element, the working elements of the available functional units differing from one another by type and/or dimension. Preferably, the differing types of working elements of the different functional units comprise one or more of the following kinds of working elements: having a backing plate made of different material, having different weights and/or centers of gravity, being provided with or without damping layers, being provided with damping layers made of different materials, being provided with or without separate working sheets, having a certain type of attachment layer for attaching different working sheets or having different forms and dimensions. The possible forms comprise but are not limited to a delta shape, a circular shape and a rectangular shape. The different types of working elements could also comprise different characteristics in terms of flexibility, softness, resilience, durability against wear and mechanical stresses. Furthermore, it is suggested that the differing types of working elements of the different functional units comprise working elements of the same kind but with different dimensions, in particular circular working elements having different diameters.

By way of example, the following characteristics of the actuating movement and the working element of a polisher and/or sander could be realized by different functional units, wherein the different rotational speeds would be defined by the gear mechanism used in the tool and the adjustment by the operator:

1) 2.000-4.200 rotations per minute (RPM); 21 mm orbit; 150 mm diameter of the backing plate,
2) 2.000-4.200 RPM; 21 mm orbit; 180 mm diameter of the backing plate,
3) 2.000-5.000 RPM; 15 mm orbit; 125 mm diameter of the backing plate,
4) 4.000-5.500 RPM; 12 mm orbit; 30 mm diameter of the backing plate,
5) 4.000-5.500 RPM; 12 mm orbit; 50 mm diameter of the backing plate,
6) 4.000-5.500 RPM; 12 mm orbit; 75 mm diameter of the backing plate,
7) 4.000-5.500 RPM; 12 mm orbit; 125 mm diameter of the backing plate,
8) 0.0-11.000 RPM; 15 mm orbit; 75 mm diameter of the backing plate,
9) 0.0-10.000 RPM; 5 mm orbit; 50 mm diameter of the backing plate, and
10) 0.0-10.000 RPM; 3 mm orbit; 30 mm diameter of the backing plate.

Of course, the different functional units adapted to be releasably connected to the rest of the power tool can comprise many other combinations of the various characteristics of the actuating movement of the working element and of the type of working element, even if not explicitly mentioned here.

It is suggested that the hand held and/or hand guided power tool according to the present invention is one of a polisher, a sander, a grinder, a drill, a cordless screw driver, a mixer, and an electric saw.

The present invention also refers to a functional unit of a hand held and/or hand guided power tool of the above mentioned type. In particular, the tool comprises a housing with a motor located inside the housing and a working element performing an actuating movement if the tool is actuated. The motor is adapted to actuate a tool shaft in order to make it perform a rotational movement. It is suggested that the functional unit comprises the working element and a carrier element, which translates the rotational movement of the tool shaft into the actuating movement of the working element, wherein the functional unit is detachably fixed to the rest of the tool. Such a functional unit has the advantage that even though only using one and the same tool body different functional units can be attached thereto having different characteristics of the actuating movement and the working element (type and dimensions).

According to one embodiment a releasable connection is employed for fixing the functional unit to the rest of the tool, which is torque proof at least in one direction of rotation of the working element.

Preferably, the carrier element is detachably fixed to the tool shaft by a threaded connection designed such that acceleration of the tool shaft upon activation of the tool will fasten the threaded connection and tighten the fixation of the functional unit to the rest of the tool.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
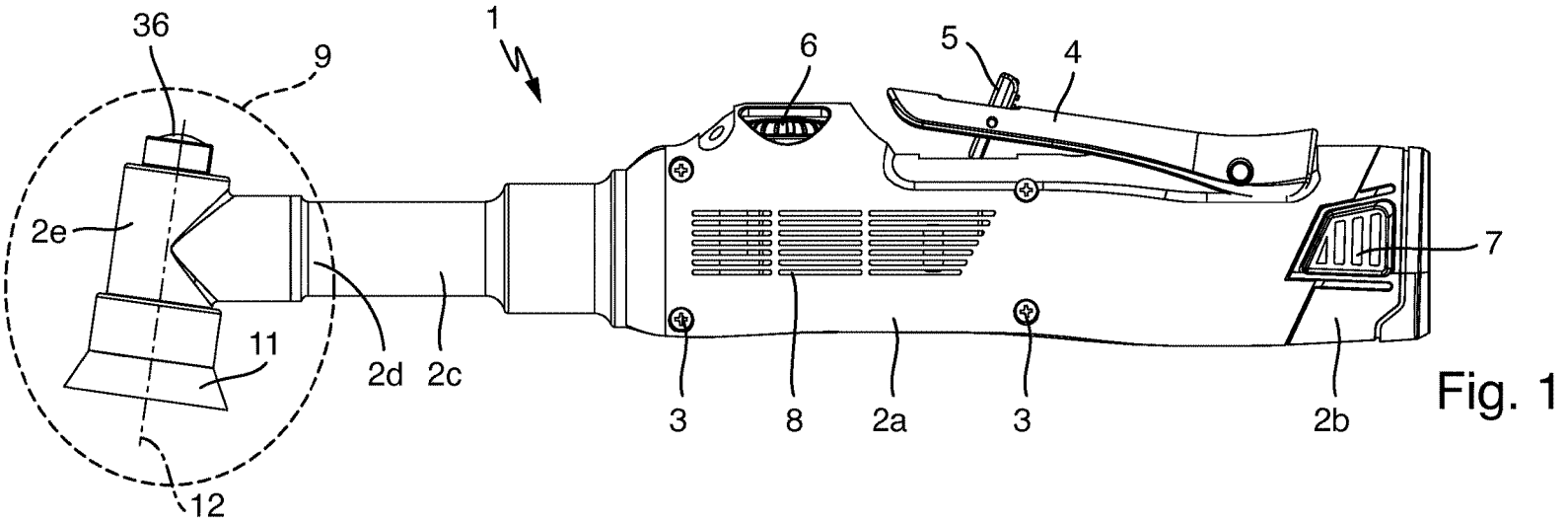
FIG. 1 is a side view of a hand held and/or hand guided power tool according to the present invention.
Figure 2:
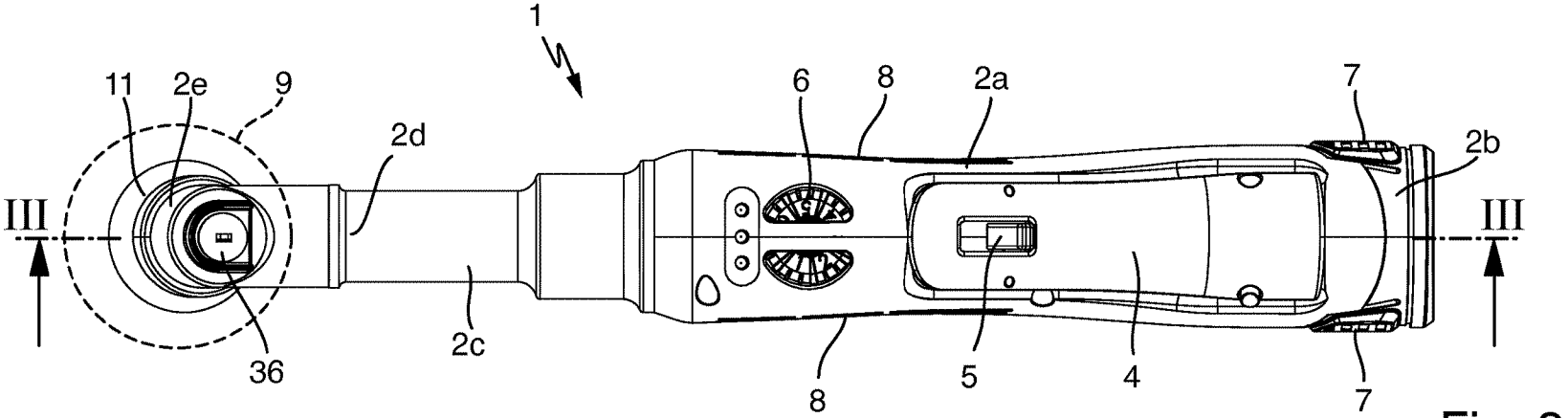
FIG. 2 is a top view of the power tool of FIG. 1.

FIGS. 1 and 2 show a side view of a hand held and/or hand guided power tool embodied as a polishing machine or a polisher. The polisher in its entirety is designated with reference sign 1. Alternatively, the power tool 1 according to the present invention could also be embodied as a sander or a grinder, or even as a drill, a cordless screw driver, a mixer, or an electric saw, only to mention a few examples.

The polisher 1 includes a housing 2 made up of essentially two main parts, a rear part 2*a* and a front part 2*c*. In more detail the housing 2 comprises the rear part 2*a*, a distal end part 2*b*, the front part 2*c* and a front casing 2*e*. The rear part 2*a* is preferably made of a rigid plastics material. Of course, the rear part 2*a* of the housing could also be made of a different rigid material, for example metal or carbon fiber. Further, the rear part 2*a* of the housing 2 could comprise regions provided with resilient material like a soft plastic material or rubber in order to ensure safe and comfortable gripping, holding and guiding of the power tool 1 by a user or operator. The rear part 2*a* of the housing is preferably divided into two half shells which are attached on one another along an essentially vertical plane and held together by screws 3.

The rear part 2*a* of the housing 2 includes an actuation lever 4 co-operating with a switch for turning on and off the polisher 1. The actuation lever 4 has a blocking mechanism 5 for avoiding unintentional activation of the tool 1. Furthermore, the rear part 2*a* of the housing is provided with a turn wheel 6 for speed regulation of a tool's motor. A distal rear end 2*b* of the rear part 2*a* of the housing can be removed in order to withdraw a battery 14 (see FIG. 3) from the inside of the rear part 2*a* of the housing 2. The battery 14 provides the polisher 1 and its electronic components, respectively, with electric energy necessary for their operation. Of course, the polisher 1 could also be operated with electric energy from a mains power supply. In that case a battery 14 would not be necessary and the compartment for the battery could be used for accommodating a transformer and other electric circuitry for transforming the mains voltage from 100V to 250V and from 50 Hz to 60 Hz, into an operating voltage (e.g. 12V, 18V, or 24V) for the electronic components of the polisher 1. The distal end 2*b* of the housing 2 is secured to the rear part 2*a* by a snap-action connection comprising two opposite lateral knobs 7 for releasing the snap-connection. For removing the distal rear end 2*b* from the rear part 2*a* of the housing 2, the lateral snap-releasing knobs 7 are pressed, thereby releasing the snap-action connection and allowing separation of the distal end 2*b* of the housing 2 from the rear part 2*a* and withdrawal of the battery 14 from the housing 2. The rear part 2*a* of the housing 2 is provided with a plurality of slots 8 enabling an airstream from the inside to the outside of the housing 2 and cooling of the electronic components located inside the housing 2.

Furthermore, located inside the rear part 2*a* of the housing 2 is an electric motor 16, preferably a brushless (BL) motor, in particular a BL direct current (BLDC) motor, with a motor shaft 16*a*, which actuates a first gear mechanism 17 which can determine a certain ratio between the rotational speed of the motor shaft 16*a* and the rotational speed of a tool shaft 19 and/or 23, which eventually drives the working element 11. Depending on the design of the gear mechanism 17, the ration can be 1, larger than 1 or smaller than 1. Usually, the ratio will be larger than 1 because the motor shaft 16*a* turns faster than the tool shaft 23. Preferably, the first gear mechanism 17 is an epicyclic gear. The gearbox output shaft is designated with reference sign 18. The output shaft 18 is connected to a first tool shaft 19 by a coupling assembly 20.

The power tool 1 can include a second gear mechanism 24 in order to translate the rotational movement of the motor shaft 16*a* and of the first tool shaft 19, respectively, about a first rotational axis 22 into a rotational movement of a second tool shaft 23, which actuates the working element 11, about a second rotational axis 12, whereas the two axes 12, 22 intersect at a certain angle larger than 0° and smaller than 180°, in particular around 90°. Preferably, the angle of the two rotational axes 12, 22 is approximately 98°. The second gear mechanism 24 can include a bevel gear with two bevel gear wheels 26. In contrast to the embodiment of FIG. 3 the first and second gear mechanism 17, 24 could also be designed as a single gear mechanism located in the front part of the tool 1, e.g. in a tool head 9. Alternatively, the tool 1 according to the present invention may also include only one of the two gear mechanisms 17, 24 or no gear mechanism at all. Furthermore, a printed circuit board (PCB) comprising electric and electronic components which together form at least part of a control unit 6*a* is located inside the housing 2. Preferably, the control unit 6*a* includes a microcontroller and/or a microprocessor for processing a computer program which is programmed to perform the desired motor control function, when it is processed on the microprocessor.

Attached to a front end of the rear part 2*a* is the front part 2*c* of the housing 2. The front part 2*c* is preferably made of metal or a rigid plastics material. The front part 2*c* can be fixed to the rear part 2*a* of the housing 2 by screws or similar attachment mechanism commonly known in the art. Of course, the front part 2*c* and the rear part 2*a* of the housing 2 could be embodied as a single common housing unit, too. A tool head 9 is fixed to a front distal end 2*d* of the front part 2*c* of the housing 2. The tool head 9 is preferably fixed to the distal end 2*d* by screws or similar attachment mechanism or by a threaded connection 2*f*. The tool head 9 comprises the casing 2*e* preferably made of metal or a rigid plastics material. The tool head 9 further includes a working element 11 and the second gear mechanism 24 (see FIGS. 3 to 6) for translating the rotational movement of the motor shaft 16*a* and the first tool shaft 19 (see FIG. 3) into a corresponding rotational movement of the second tool shaft 23 about the rotational axis 12.

The distal rear end 2*b* of the rear part 2*a* of the housing 2 is attached to or forms integral part with a battery pack 13 comprising the battery 14 and possibly other electric or electronic components. Upon insertion of the battery pack 13 into the rear part 2*a* of the housing 2 it is automatically connected to electric connectors 15, fixedly located inside the housing 2. Electric energy stored in the battery 14 is provided to the other electrical components of the polisher 1 via the connectors 15.

The coupling of the coupling assembly 20 is such that torque is transmitted from the gear output shaft 18 to the first tool shaft 19. The tool shaft 19 is rotatably supported in the front part 2*c* of the housing 2 by bearings 21 such that it rotates about the rotational axis 22. In the shown embodiment the rotational axis 22 of the first tool shaft 19 is identical to a rotational axis of the gear output shaft 18 of the first gear mechanism 17. The rotational movement of the output shaft 18 and the first tool shaft 19, respectively, is transmitted to a second tool shaft 23 by the second gear mechanism 24. The second tool shaft 23 is rotably supported about the rotational axis 12 of the tool head 9 by bearings 25.

Attached to the second tool shaft 23 is a functional unit 27 according to the present invention, which provides for a functional connection between the second tool shaft 23 and the working element 11. The functional unit 27 determines the type of actuating movement of the working element 11. To this end the functional unit 27 includes a carrier element 28 which holds the working element 11. Depending on the type and design of the functional unit 27 and the carrier element 28, respectively, the actuating movement of the working element 11 can include one or more of the following kind: a purely rotational, a random-orbital, a roto-orbital, a planetary, a linear and a linear or rotary alternating back-and-forth actuating movement. Furthermore, the functional unit 27 is detachably fixed to the rest of the tool 1, e.g. to a distal end of a tool shaft, for instance of the second tool shaft 23. The functional unit 27 and its attachment to the rest of the tool 1 are described in more detail with reference to FIGS. 5 and 6 below.

The working element 11 can include a backing plate 11*a*, which is preferably made of expanded polyurethane and particularly resistant to mechanical stresses. A supporting structure 11*b*, for example made of metal or a rigid plastics material, is embedded into the top of the backing plate 11*a*. A bottom surface 11*c* of the backing plate 11*a* is provided with attachment mechanism, for example a hook-and-loop-fastener, a glued surface for mechanical adhesion, for removably attaching a working sheet, for example a polishing pad 11*d* made of a foamed material or microfiber, a polishing cushion made of wool or similar material, or an abrasive sheet material. Of course, the working element 11 and the backing plate 11*a*, respectively, could also be used directly for working a surface of a workpiece, without the need to attach a separate working sheet to the bottom surface 11*c*. In that case, the backing plate 11*a* and the bottom surface 11*c* could be designed such that they can directly perform a sanding or polishing operation on the workpiece surface or the working sheet could be integrally formed (e.g. by a molding process) on or inseparably attached (e.g. glued or welded) to the bottom surface 11*c* of the backing plate 11*a*.

The user or operator of the tool 1 can replace a working sheet attached to the bottom surface 11*c* of the backing plate 11*a* (leaving the rest of the working element 11 attached to the tool 1). Alternatively or additionally the user can also replace the working element 11 in its entirety (leaving the rest of the functional unit 27 attached to the tool 1). Furthermore, alternatively or additionally the user can also replace the functional unit 27 in its entirety comprising the working element 11 and, if present, the working sheet 11*d* attached thereto. Of course, after replacing the functional unit 27 the previously used working element 11 and/or working sheet 11*d* could be re-attached to the new functional unit 27. Preferably, the bevel gear mechanism 24 cannot be replaced by a different gear mechanism. However, theoretically it could be possible to design the tool 1 such that the entire tool head 9 can be replaced, including the gear mechanism 24 and the functional unit 27 with the working element 11.

Figure 3:
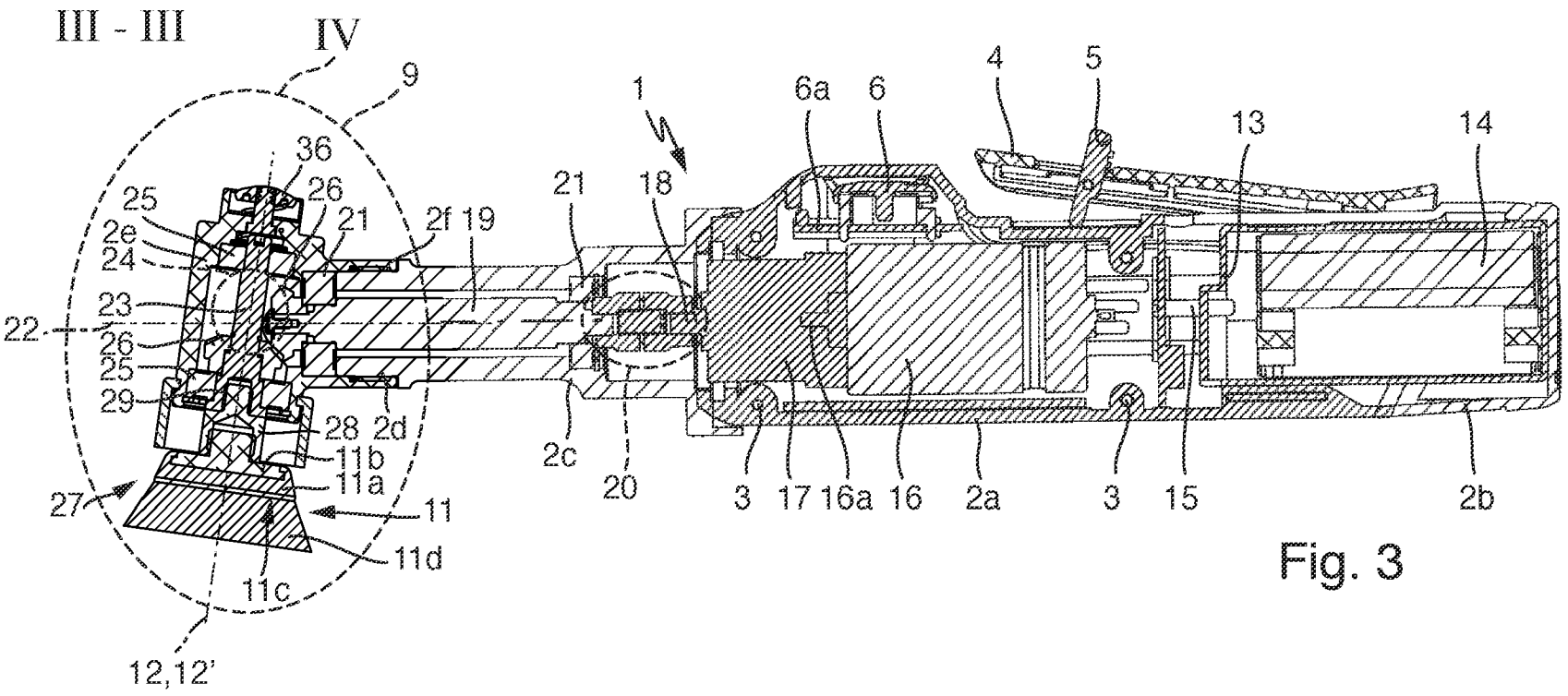
FIG. 3 is a longitudinal sectional view of the power tool of FIGS. 1 and 2 along line III-III of FIG. 2.
Figure 4:
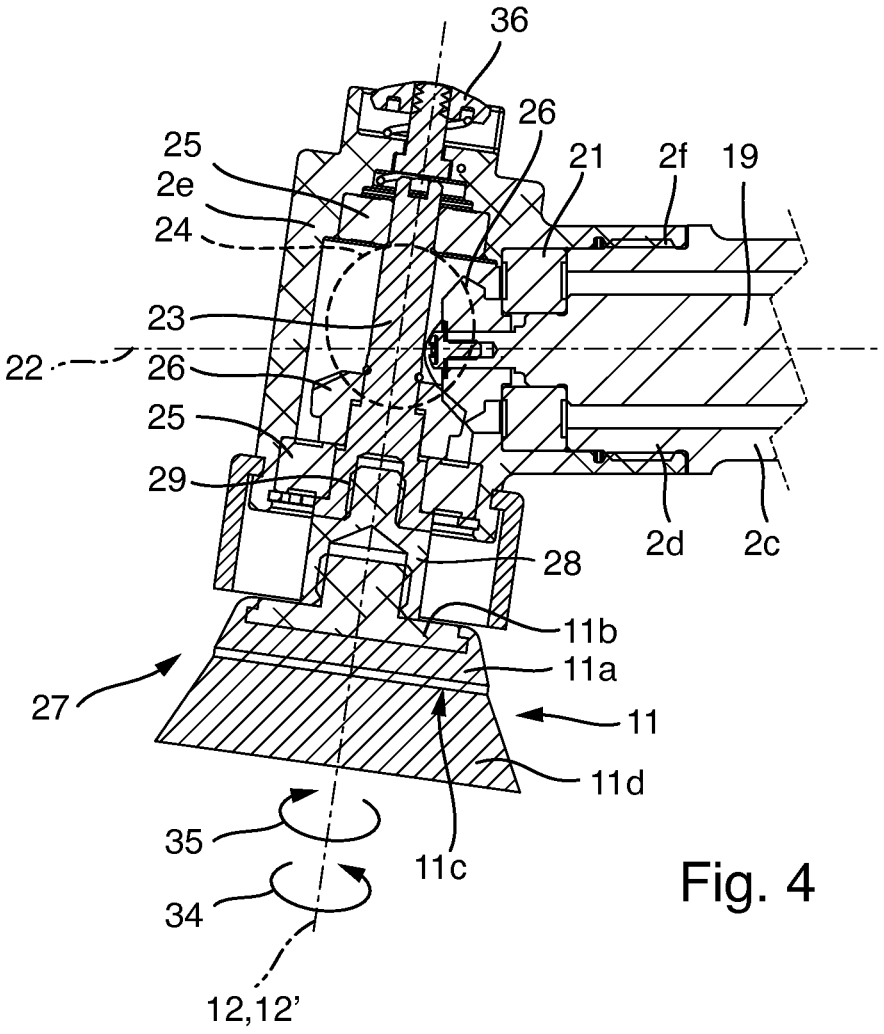
FIG. 4 is a sectional view of detail IV of FIG. 3.
Figure 5:
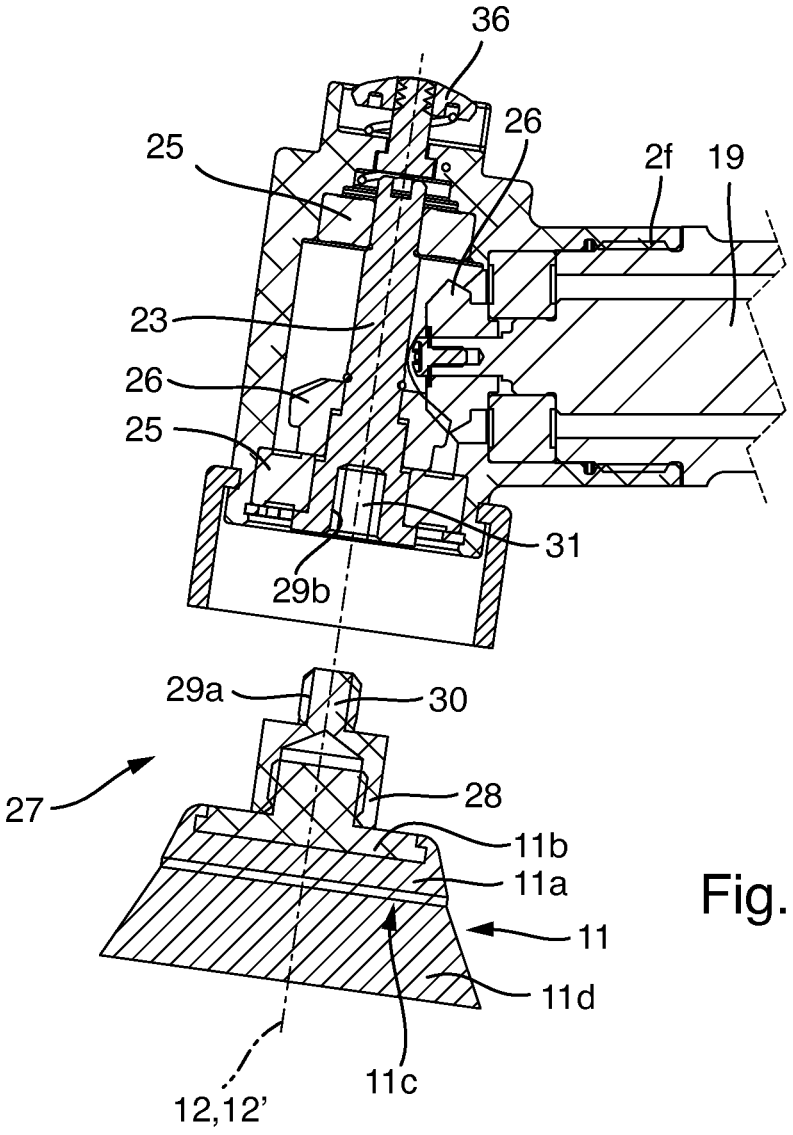
FIG. 5 is the detail IV shown in FIG. 4 with a first embodiment of a functional unit according to the present invention detached from the rest of the power tool.

FIG. 4 shows a detailed view of section IV of FIG. 3 including the tool head 9 and the functional unit 27 performing a purely rotational actuating movement. The functional unit 27 comprising the carrier element 28 and the working element 11 is releasably attached to the distal end of the second tool shaft 23 by a threaded connection 29. FIG. 5 shows the functional unit 27 of FIG. 4 detached from the rest of the tool 1. The functional unit 27 can be detached from the second tool shaft 23 by inhibiting rotation of the tool shaft 23 and contemporaneously rotating the functional unit 27 about the rotational axis 12, in order to loosen the threaded connection 29. The rotation of the second tool shaft 23 can be inhibited by pressing an appropriate brake or interference button 36 at the top of the tool head 9. Of course, inhibiting the rotation of the tool shaft 23 can be designed in any other appropriate form and can be located in any other appropriate position.

As can be seen from FIG. 5, the threaded connection 29 includes an external thread 29*a* embodied on a shaft 30 of the carrier element 28. Furthermore, the threaded connection 29 comprises a second internal thread 29*b* located within a bore 31 at a distal end part of the second tool shaft 23. Preferably, seen from the bottom of the working element 11 or from the top of the tool 1, a direction 34 of the threaded connection 29 is opposite to a direction 35 of the rotational movement of the second tool shaft 23 about the rotational axis 12. In the embodiment shown in FIG. 4 the direction 35 of the rotational movement of the second tool shaft 23 seen from above is clockwise. The threaded connection 29 would go into the respective opposite direction 34, that is seen from above counter-clockwise. This has the advantage that during use of the tool 1, the connection between the functional unit 27, 27' and the rest of the tool 1 is automatically fastened and will not loosen unintentionally. Alternatively, the direction 35 of the rotational movement of the shaft 23 could also be directed counter-clockwise, in which case the direction 34 of the thread would be clockwise. This allows a transmission of torque at least in the direction 35 of the rotational movement of the second tool shaft 23. Of course, the mechanism for releasably connecting the functional unit 27 to the rest of the tool 1, in particular to the second tool shaft 23, can be designed in any other appropriate manner, too.

It can be clearly seen from FIG. 5, that the functional unit 27 includes the carrier element 28 and the working element 11. The carrier element 28 shown in FIG. 5 holds the working element 11 with a rotational axis 12' of the working element 11 congruent with the rotational axis 12 of the second tool shaft 23. Hence, the working element 11 performs a purely rotational actuating movement around axis 12, 12'. In other words, the rotational axis 12 is the same for the second tool shaft 23, the shaft 30 of the carrier element 28 and the working element 11. To this end, the carrier unit 28 can be attached to the distal end of the tool shaft 23 in a torque proof manner and the working element 11 is attached in a torque proof manner to the carrier unit 28 as well. In the embodiments of FIGS. 1 to 5 the torque proof connections are effected by threaded connections comprising externally threaded rods being screwed into bores having corresponding internal threads.

Figure 6:
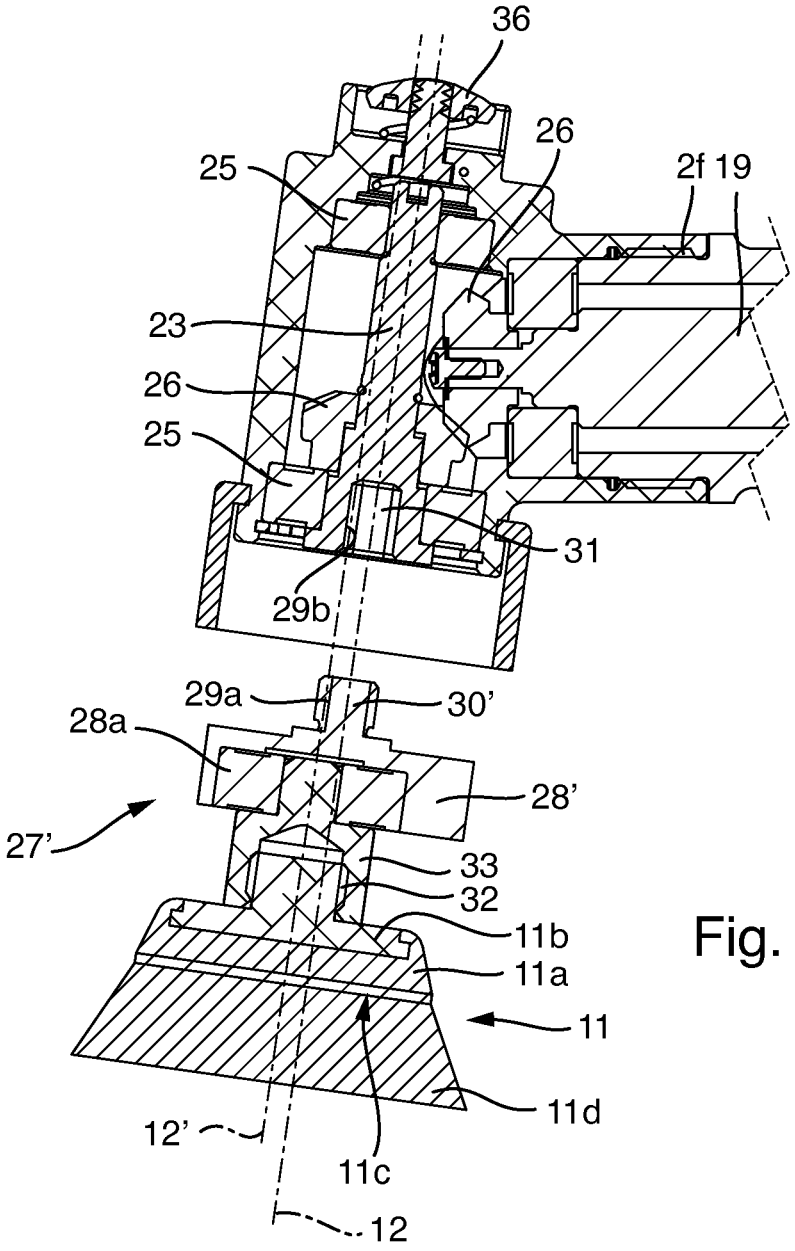
FIG. 6 is the detail IV shown in FIG. 4 with a second embodiment of a functional unit according to the present invention detached from the rest of the power tool.

The functional unit 27 shown in FIG. 5 can be replaced by another functional unit 27', like the one shown in FIG. 6. It can be clearly seen that in the embodiment of the functional unit 27' of FIG. 6 the rotational axis 12' of the working element 11 is not identical to the rotational axis 12 of the second tool shaft 23. Rather, the two rotational axes 12, 12' run parallel to and spaced apart from one another. Furthermore, the carrier element 28' forms an eccentric set, comprising an eccentric bearing 28*a* (e.g. one or more ball bearings or a double row ball bearing) and a spindle 33, adapted for receiving the working element 11. The spindle 33 is connected to the supporting member 11*b* of the working element 11 in a torque proof manner by a further threaded connection 32. Of course, there are many other possibilities for connecting the working element 11 to the spindle 33 in a torque proof manner. The spindle 33 could also be an integral part of the supporting member 11*b* of the working element 11. The spindle 33 is held freely rotatable about the rotational axis 12' in the carrier element 28' by the bearings 28*a*. Together, the rotational movement of the eccentric carrier element 28' about the rotational axis 12 plus the possibility for the spindle 33 to freely rotate about the rotational axis 12' determine the random orbital actuating movement of the working element 11. Hence, the functional unit 27' of FIG. 6 has a carrier element 28', which translates the rotational movement of the second tool shaft 23 about the rotational axis 12 into a random orbital actuating movement of the working element 11.

Of course, the working element 11 of the functional unit 27' of FIG. 6 could perform any other type of actuating movement, too, if the carrier element 28' was designed accordingly. In any case, the actuating movement of the working element 11 of the functional unit 27' of FIG. 6 is different from the actuating movement of the working element 11 of the functional unit 27 of FIG. 5. Hence, the polisher 1 can perform different types of actuating movements of its working element 11 simply by replacing the functional unit 27 by another functional unit, like the functional unit 27' of FIG. 6.

Each functional unit 27, 27' can receive different working elements 11. For example, the functioning unit 27', which performs a random orbital movement, can comprise circular working elements 11 with diameters of 30 mm or 50 mm. Similarly, an identical working element 11, for example a circular working element with a diameter of 70 mm, could be mounted onto the functional unit 27 performing the purely rotational movement of the working element 11, as well as onto the functional unit 27' defining the random orbital movement.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A hand operated power tool comprising a housing with a motor operatively supported in the housing and a tool shaft operatively connected to said motor and driven by said motor so as to perform a rotational movement, at least one functional unit mountable to the tool shaft, said functional unit including a carrier and a working element wherein said carrier is disposed between said tool shaft of said working element such that rotational movement of the tool shaft is translated into the actuating movement of the working element through said carrier, wherein the functional unit is separate from the rest of the tool but is fixed to the rest of the tool by a releasable connection, which is torque proof at least in one direction of rotation of the working element, and is detachably fixed to the tool shaft, said housing has a longitudinal extension enclosing the motor, a first gear mechanism and a first tool shaft are located in the housing and extend along a longitudinal extension of the housing, wherein the first tool shaft rotates about a first rotational axis, and wherein a second tool shaft, which actuates the functional unit, rotates about a second rotational axis, wherein the two axes intersect each other in an angle being larger than 0° and smaller than 180°.

2. The hand operated power tool as set forth in claim 1, wherein the carrier element of the functional unit is detachably fixed to the tool shaft by a threaded connection designed such that acceleration of the tool shaft upon activation of the tool fastens the threaded connection and tightens the fixation of the functional unit to the rest of the tool.

3. A hand operated power tool comprising a housing with a motor operatively supported in the housing and a tool shaft operatively connected to said motor and driven by said motor so as to perform a rotational movement, at least one functional unit mountable to the tool shaft, said functional unit including a carrier and a working element wherein the working element comprises a backing plate and a working sheet on a bottom surface of the backing plate, the working sheet adapted for working a surface of a workpiece, wherein the backing plate is releasably fixed to the rest of the functional unit, wherein said carrier is disposed between said tool shaft of said working element such that rotational movement of the tool shaft is translated into the actuating movement of the working element through said carrier, wherein the functional unit is separate from the rest of the tool, and is detachably fixed to the tool shaft, said housing has a longitudinal extension enclosing the motor, a first gear mechanism and a first tool shaft are located in the housing and extend along a longitudinal extension of the housing, wherein the first tool shaft rotates about a first rotational axis, and wherein a second tool shaft, which actuates the functional unit, rotates about a second rotational axis, wherein the two axes intersect each other in an angle being larger than 0° and smaller than 180°.

4. The hand operated power tool as set forth in claim 3, wherein the backing plate is releasably fixed to said carrier element of the functional unit by a further threaded connection.

5. The hand operated power tool as set forth in claim 1, wherein the tool is one of a polisher, a sander, or a grinder.

6. The hand operated power tool as set forth in claim 1, wherein the angle between the two axes is approximately 90°.

7. The hand operated power tool as set forth in claim 1, wherein the power tool comprises a second gear mechanism adapted for translating the rotational movement of the first tool shaft into a rotational movement of the second tool shaft.

8. A hand operated power tool comprising a housing with a motor operatively supported in the housing and a tool shaft operatively connected to said motor and driven by said motor so as to perform a rotational movement, at least one functional unit mountable to the tool shaft, said functional unit including a carrier and a working element wherein said carrier is disposed between said tool shaft of said working element such that rotational movement of the tool shaft is translated into the actuating movement of the working element through said carrier, wherein the functional unit is separate from the rest of the tool, and is detachably fixed to the tool shaft, wherein the rest of the tool includes a receiving section to which the functional unit is detachably fixed, wherein said receiving section makes part of the tool shaft and is designed to receive different types of functional units comprising different types of carrier elements and/or working elements, said housing has a longitudinal extension enclosing the motor, a first gear mechanism and a first tool shaft are located in the housing and extend along a longitudinal extension of the housing, wherein the first tool shaft rotates about a first rotational axis, and wherein a second tool shaft, which actuates the functional unit, rotates about a second rotational axis, wherein the two axes intersect each other in an angle being larger than 0° and smaller than 180°.

9. The hand operated power tool as set forth in claim 8, wherein a plurality of different functional units are available, each of which can be detachably fixed to the rest of the tool and each of which has a carrier element designed such that the working element of the functional unit performs a certain type of actuating movement, the actuating movements of the working elements of the different functional units differing from one another by type and/or degree.

10. The hand operated power tool as set forth in claim 9, wherein the differing types of actuating movements performed by the working elements of the different functional units comprise one or more of the following kind: a rotational, a random-orbital, a roto-orbital, a planetary, a linear, a linear or rotary alternating back and forth actuating movement.

11. The hand operated power tool as set forth in claim 8, wherein a plurality of different functional units are available, each of which can be detachably fixed to the rest of the tool and each of which has a working element, the working elements of the different functional units differing from one another by type and/or dimension.

12. The hand operated power tool as set forth in claim 11, wherein the differing types of working elements of the different functional units comprise one or more of the following kinds of working elements: having a backing plate with a working sheet integrally formed on a bottom surface of the backing plate, having a backing plate with an attachment layer on its bottom surface for releasably attaching separate working sheets, the working sheets being adapted for polishing, sanding, abrading or grinding surfaces of workpieces and/or having backing plates with different forms, like a delta shape, a rectangular shape or a circular shape, and/or having backing plates with different dimensions.

13. The hand operated power tool as set forth in claim 8, wherein the power tool is provided with means for inhibiting the rotation of the tool shaft.

14. The hand operated power tool as set forth in claim 13, wherein the means for inhibiting the rotation of the tool shaft comprise a brake or interference button located in a front part of the power tool, in particular at the top of a tool head.

15. The hand operated power tool as set forth in claim 3, wherein the working sheet is an integral part of the backing plate or is part of a separate working sheet releasably fixed to the bottom surface of the backing plate.

16. A hand operated power tool comprising a housing with a motor operatively supported in the housing and a tool shaft operatively connected to said motor and driven by said motor so as to perform a rotational movement, at least one functional unit mountable to the tool shaft, said functional unit including a carrier and a working element wherein said carrier is disposed between said tool shaft of said working element such that rotational movement of the tool shaft is translated into the actuating movement of the working element through said carrier, wherein the functional unit is separate from the rest of the tool, and is detachably fixed to the tool shaft, said housing has a longitudinal extension enclosing the motor, a first gear mechanism and a first tool shaft are located in the housing and extend along a longitudinal extension of the housing, wherein the first tool shaft rotates about a first rotational axis, and wherein a second tool shaft, which actuates the functional unit, rotates about a second rotational axis, wherein the two axes intersect each other in an angle that is approximately 98°.

17. A hand operated power tool comprising a housing with a motor operatively supported in the housing and a tool shaft operatively connected to said motor and driven by said motor so as to perform a rotational movement, at least two interchangeable functional units, each interchangeably mountable to the tool shaft, each of said functional units including a working element and a carrier element, wherein one of said interchangeable functional units is adapted to be rotatably driven in response to the rotational movement of said tool shaft and said other of said interchangeable functional units is adapted to be driven in an eccentric movement in response to rotational movement of said tool shaft, wherein each carrier is disposed between said tool shaft of said associated working element such that rotational movement of the tool shaft is translated into the actuating movement of the working element through said carrier, wherein the functional unit is separate from the rest of the tool, and is detachably fixed to the tool shaft, said housing has a longitudinal extension enclosing the motor, a first gear mechanism and a first tool shaft are located in the housing and extend along a longitudinal extension of the housing, wherein the first tool shaft rotates about a first rotational axis, and wherein a second tool shaft, which actuates the functional unit, rotates about a second rotational axis, wherein the two axes intersect each other in an angle being larger than 0° and smaller than 180°.

* * * * *